United States Patent [19]

Waters

[11] Patent Number: 4,551,865

[45] Date of Patent: Nov. 12, 1985

[54] VENTILATOR FOR A LAVATORY PAN

[76] Inventor: Dudley G. Waters, 8/47 Victoria Terr., Caloundra Headland, Australia

[21] Appl. No.: 672,268

[22] PCT Filed: Feb. 24, 1984

[86] PCT No.: PCT/AU84/00026

§ 371 Date: Oct. 29, 1984

§ 102(e) Date: Oct. 29, 1984

[87] PCT Pub. No.: WO84/03316

PCT Pub. Date: Aug. 30, 1984

[30] Foreign Application Priority Data

Feb. 28, 1983 [NZ] New Zealand ..... 203413

[51] Int. Cl.[4] ..... E03D 9/02

[52] U.S. Cl. ..... 4/213; 4/209 R; 4/211

[58] Field of Search ..... 4/213, 211, 209 R, 214, 4/218, 216

[56] References Cited

U.S. PATENT DOCUMENTS

| | | | |
|---|---|---|---|
| 1,734,498 | 11/1929 | Majauskas | 4/213 |
| 1,885,715 | 11/1932 | Hanson | 4/213 |
| 1,931,052 | 10/1933 | Baither | 4/213 |
| 2,047,067 | 7/1936 | Harris | 4/213 |
| 2,126,131 | 8/1938 | Orebaugh | 4/213 |
| 2,631,298 | 3/1953 | Nofsinger | 4/213 |
| 2,777,137 | 1/1957 | McFadden | 4/213 |
| 4,494,255 | 1/1985 | Drummond | 4/213 |

*Primary Examiner*—Henry K. Artis

*Attorney, Agent, or Firm*—Larson and Taylor

[57] ABSTRACT

A ventilator for withdrawing foul air from a lavatory pan has, within a housing (16), a duct (11) for connection between the discharge pipe (31) of the lavatory flushing assembly and the flush pipe (33) of the lavatory pan. An extractor fan (41) is provided in the housing (16) for withdrawing air from the duct (11) by way of an air passage (28) therein and expelling it through an exhaust pipe (47) to atmosphere outside the lavatory. The air passage (28) may be opened or closed by a valve (27). The fan (41) may be switched on when the valve (27) is open. When the lavatory pan is flushed, water passing through the duct (11) moves a cup (25) connected to the valve (27) so as to close the valve (27) and switch off the fan (41).

6 Claims, 4 Drawing Figures

VENTILATOR FOR A LAVATORY PAN

BACKGROUND OF THE INVENTION

1. Field of the Invention

This invention relates to a ventilator for a lavatory pan.

2. Prior Art

Devices for the treatment and/or removal of foul air from a lavatory pan are known, such a device commonly incorporating an extractor fan to withdraw, and exhaust to atmosphere outside the lavatory, air from the discharge pipe leading from the lavatory cistern to the lavatory pan. The installation of such a ventilator has usually involved considerable costly plumbing work, and the completed installation is likely to be obstrusive and unattractive in appearance.

SUMMARY OF THE PRESENT INVENTION

The present invention has been devised with the general object of providing a ventilator for a lavatory pan which is simple and economical to manufacture and to instal, particularly efficient in operation, and neat and unobstrusive in appearance.

With the foregoing and other objects in view, the invention resides broadly in a ventilator for a lavatory pan including a duct for connecting the discharge pipe of a lavatory flushing assembly to the flush pipe of a lavatory pan; an electric extractor fan having an inlet and an outlet to atmosphere; an air passage in the duct connected to the extractor fan inlet; a valve for opening or closing the air passage; initiating means for operating the extractor fan when the valve is in open position; and terminating means operated by flow of water from the discharge pipe and duct for automatically closing the valve and stopping the extractor fan. Preferably the duct is in the form of an elbow with a downwardly extending arm connectible at its top to the discharge pipe and a normally substantially horizontal arm, including a valve chamber, and connectible to the flush pipe, the air passage leading from the valve chamber and the valve being pivotally mounted within the duct. The initiating means preferably includes a switch arm manually movable to its operative position to switch on the extractor fan, and movable by the valve when closing to its inoperative position, switching off the fan.

The terminating means preferably includes a member, which may be of cup-like form, connected to the valve and movable by flow of water through the duct to move the valve to its closed position.

Other features of the invention will become apparent from the following description.

BRIEF DESCRIPTION OF THE DRAWINGS

In order that a preferred embodiment of the invention may be readily understood and carried into practical effect, reference is now made to the accompanying drawings, wherein.

DETAILED DESCRIPTION OF THE PREFERRED EMBODIMENT

Figure 1:
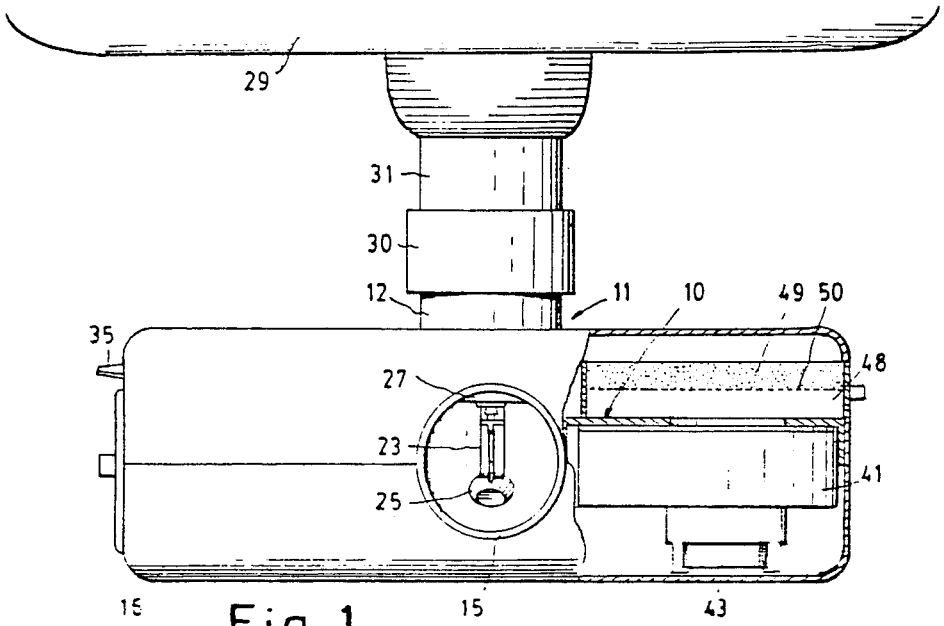
FIG. 1 is a partly broken-away front elevational view of a device according to the invention.
Figure 2:
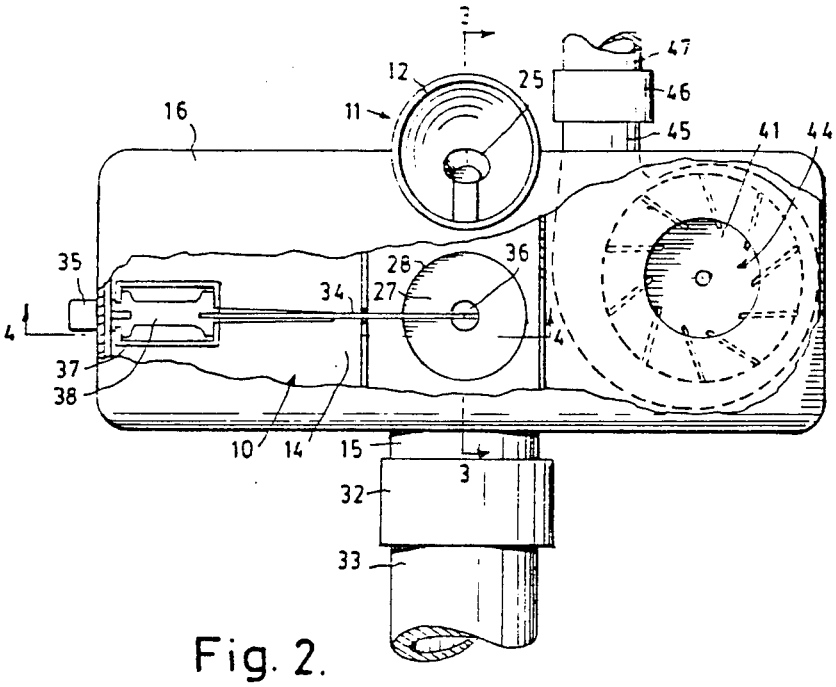
FIG. 2 is a partly broken-away plan view of the device.

The ventilator shown in the drawings includes a mounting frame 10, which may suitably be of a plastics material, moulded integrally with a duct 11 in the form of a elbow having a round-section inlet arm 12 extending downwardly into the rear of a forwardly-extending valve chamber 13. The lower part of the valve chamber is of semi-circular section, its upper part having parallel sides joining perpendicularly a top plate 14 of the mounting frame 10. A round-section duct outlet 15 is secured to the front of the mounting frame to lead coaxially from the valve chamber.

The mounting frame is enclosed within a housing 16 comprising upper and lower parts which may be moulded of a plastics material, the power part of the housing having integral supports 17 for the valve chamber and locking means at 18 for snapping the valve chamber into place relative to the housing.

Within the bend of the elbow duct 11 there is installed a valve fulcrum plate 19, providing a pair of spaced bearings for trunnions 20 extending from a pair of brackets 21 at opposite sides of the middle part of a cranked member 22 comprising a cup arm 23 and a valve arm 24, the two being at an angle of about 135°. At its extremity, the cup arm 23 carries a cup 25 located in the inlet arm 12 of the duct 11, and on the distal end of the valve arm 24 is a perpendicular stem 26 on which is coaxially mounted a valve 27, the steam extending for some distance above the valve.

Figure 3:
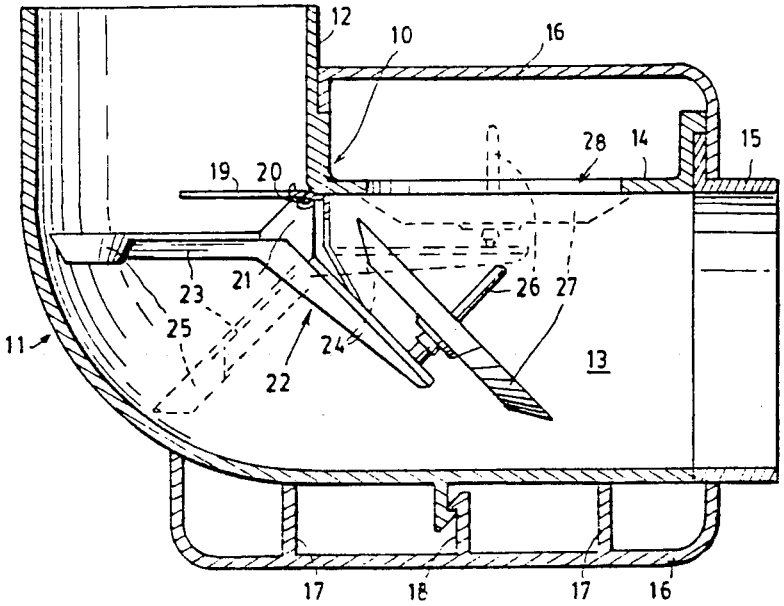
FIGS. 3 and 4 are sectional views to larger scale taken along lines 3—3 and 4—4 respectively in FIG. 2.
Figure 4:
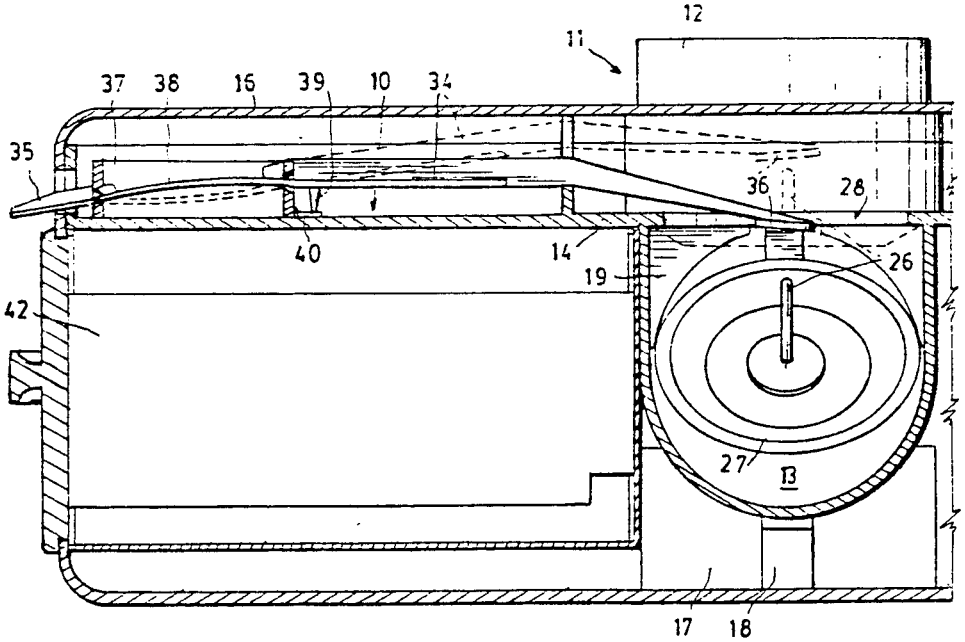

Normally, because of its weight, the valve 27 swings down to its open position, shown in full outline in FIGS. 3 and 4; but if the cup 25 is swung downwards so the valve 27 is swung upwards, to the positions shown in broken outline, the valve seats about and closes an air passage 28 in the top plate 14 of the mounting frame 10.

The ventilator device is installed below a lavatory cistern, part of which is indicated at 29 in FIG. 1, and behind the lavatory pan (not shown), the inlet arm 12 of the duct being connected by a suitable union 30 to the cistern discharge pipe 31, the outlet 15 being connected by a union 32 to the flush pipe 33 of the lavatory pan.

When the water is discharged from the cistern 29, it acts on the cup 23 to force it downwardly, so that the valve 27 is brought up to its closed position.

When the cistern has drained, the depressed cup 25 drains, and the valve 27 descends gravitationally to its open position.

Installed on the mounting frame 10 is a switch arm 34 having at one end a finger-piece 35 which extends out through an opening in the housing 16, and at the other end a pad 36. Near to its finger-piece 35, the switch arm 34 is fulcrumed in opposite ends of a fulcrum box 37 on the mounting frame top plate 14, a section 38 of the switch arm between these two fulcrums being resiliently flexible and of such length that it tends to assume either an upwardly bowed form, as shown in full outline in FIG. 4, or a downwardly bowed form, as shown in broken outline.

When the finger-piece 35 at one end of the switch arm is manually depressed, the resilient section 38 of the switch arm 34 is caused to assume its upwardly bowed form so that the pad 36 at the other end of the switch arm is depressed into, or near to, the middle of the air passage 28. When the cup 25 is depressed by water pressure so that the valve 27 is swung upwardly to closed position, the valve stem 26 strikes and lifts the pad 36 so that the resilient section 38 is caused to assume its downwardly curved form and the finger-piece 35 is raised.

Upon the finger-piece 35 being manually depressed to move the switch arm 34 as described, a projection 39 from the switch arm operates a switch 40 mounted on the mounting frame so as to close the electric circuit of an extractor fan 41 within one side of the housing 16 and energised by cells in a battery box 42 slidably installed in the other side of the housing. The extractor fan is of centrifugal type powered by an electric motor 43, and it is mounted under the mounting frame 10, an aperture 44 in the top plate 14 of which is then inlet to the fan. The rearwardly extending outlet 45 of the fan passes through the housing 16 and is connected by a union 46 to an exhaust pipe 47 carried through the lavatory wall to atmosphere.

A drawer 48 containing activated charcoal or any other odour-absorbent material 49 supported by a mesh screen 50 is slidably inserted into the housing 16 through an opening in one end, and seat over the inlet aperture 44 of the extractor fan 41.

In use, the finger-piece 35 is depressed to cause the switch 40 to be closed, bringing the extractor fan 41 into operation to withdraw foul air from the lavatory pan through the flush pipe 33, the valve chamber 13, the air passage 28 and the deodorizing material 49, and expelling it through the fan outlet 45 to atmosphere. When the lavatory pan is flushed, the pressure of water discharged from the cistern 29 depresses the cup 25 and so automatically brings the valve 27 to its closed position. As the valve closes, its stem 26 strikes and lifts the pad 36 so that the switch arm 34 reverts to its inoperative position, the extractor fan being switched off and the finger-piece 35 being returned to raised position.

Ventilator devices according to the invention will be found to be very effective in achieving the objects for which they have been devised. It will, of course, be understood that the particular embodiment of the invention herein described and illustrated may be subject to many modifications of constructional detail and design, which will be readily apparent to skilled persons, without departing from the scope of the invention defined by the appended claims.

I claim:

1. A ventilator for a lavatory pan including:

a duct for connecting the discharge pipe of a lavatory flushing assembly to the flush pipe of the lavatory pan, an electric extractor fan, having an inlet and an outlet to atmosphere, an air passage in the duct connected to the extractor fan inlet, a valve for opening or closing the air passage, initiating means for operating the extractor fan when the valve is in open position, and terminating means operated by flow of water from the discharge pipe and duct for automatically closing the valve and stopping the extractor fan.

2. A ventilator according to claim 1 wherein:

the duct is in the form of an elbow with a downwardly extending arm connectible at its top to the discharge pipe and a normally substantially horizontal arm, including a valve chamber, and connectible to the flush pipe, the air passage leads from the valve chamber, and the valve is pivotally mounted within the duct.

3. A ventilator according to claim 1 wherein the initiating means include:

a switch arm manually movable to its operative position to switch on the extractor fan, and movable by the valve when closing, to its inoperative position, switching off the extractor fan.

4. A ventilator according to claim 1 wherein the terminating means includes:

a movable member in the duct, connected to the valve and movable by flow of water through the duct to move the valve to its closed position.

5. A ventilator according to claim 1 wherein:

an odour absorbing unit is interposed between the air passage and the inlet to the extractor fan.

6. A ventilator according to claim 1 wherein:

the duct is enclosed in a housing, together with the extractor fan, initiating means, terminating means and electric cells for operating the extractor fan.

* * * * *